United States Patent [19]

Hatch et al.

[11] 4,410,498

[45] Oct. 18, 1983

[54] ACID LEACHING OF NICKEL FROM SERPENTINIC LATERITE ORES

[75] Inventors: William R. Hatch, Brampton; Ronald R. Dunn, Holland Landing, both of Canada

[73] Assignee: Falconbridge Nickel Mines Limited, Toronto, Canada

[21] Appl. No.: 312,252

[22] Filed: Oct. 16, 1981

[30] Foreign Application Priority Data

Nov. 5, 1980 [GB] United Kingdom ..... 8035578

[51] Int. Cl.[3] ..... C22B 23/04; C01G 53/10

[52] U.S. Cl. ..... 423/150; 423/146; 423/155; 75/119

[58] Field of Search ..... 423/150, 140, 141, 123, 423/146, 155; 75/119, 101 R, 115, 121

[56] References Cited

U.S. PATENT DOCUMENTS

| | | | |
|---|---|---|---|
| 2,105,456 | 1/1938 | Hubler et al. | 423/141 |
| 2,584,700 | 2/1952 | Hayward | 75/119 |
| 2,778,729 | 8/1954 | Schaufelberger | 423/141 |
| 3,793,432 | 2/1974 | Weston | 423/143 |
| 3,804,613 | 4/1974 | Zundel et al. | 75/101 R |
| 3,991,159 | 11/1976 | Queneau et al. | 423/150 |
| 4,044,096 | 8/1977 | Queneau et al. | 423/150 |
| 4,062,924 | 12/1977 | Glaum et al. | 423/150 |
| 4,065,542 | 12/1977 | Subramanian et al. | 423/35 |
| 4,098,870 | 6/1978 | Fekete et al. | 423/124 |
| 4,125,588 | 11/1978 | Hansen et al. | 423/150 |

FOREIGN PATENT DOCUMENTS

| | | | |
|---|---|---|---|
| 618826 | 5/1957 | Canada | 423/150 |

OTHER PUBLICATIONS

"Extractive Metallurgy of Copper, Nickel and Cobalt", Carlson, E. T. & Simons, C. S., AIME 1960, p. 363.

Boldt, Joseph R., Jr. *The Winning of Nickel* 1967, pp. 179, 440-449.

*Primary Examiner*—Edward J. Meros
*Assistant Examiner*—Robert L. Stoll
*Attorney, Agent, or Firm*—Ridout & Maybee

[57] ABSTRACT

Sulphuric acid leaching has been used in the treatment of lateritic ores for the recovery of nickel and cobalt therefrom. However, in order to obtain good extraction from these ores, prolonged treatment using acid of high strength and also using high pressures and recycling steps have been necessary. In the improved method of the invention nickel and cobalt is solubilized from high-magnesia nickeliferous serpentine ores by leaching the ore with an aqueous solution of sulphuric acid while adding to the solution a reducing agent to maintain the redox potential of the solution at a value between 200 and 400 millivolts, measured against the saturated calomel electrode. This improved procedure increases the reactivity of the serpentine and results in maximum extraction of nickel consistent with minimum extraction of iron and magnesia and minimum acid consumption.

6 Claims, 3 Drawing Figures

ACID LEACHING OF NICKEL FROM SERPENTINIC LATERITE ORES

Figure 1:
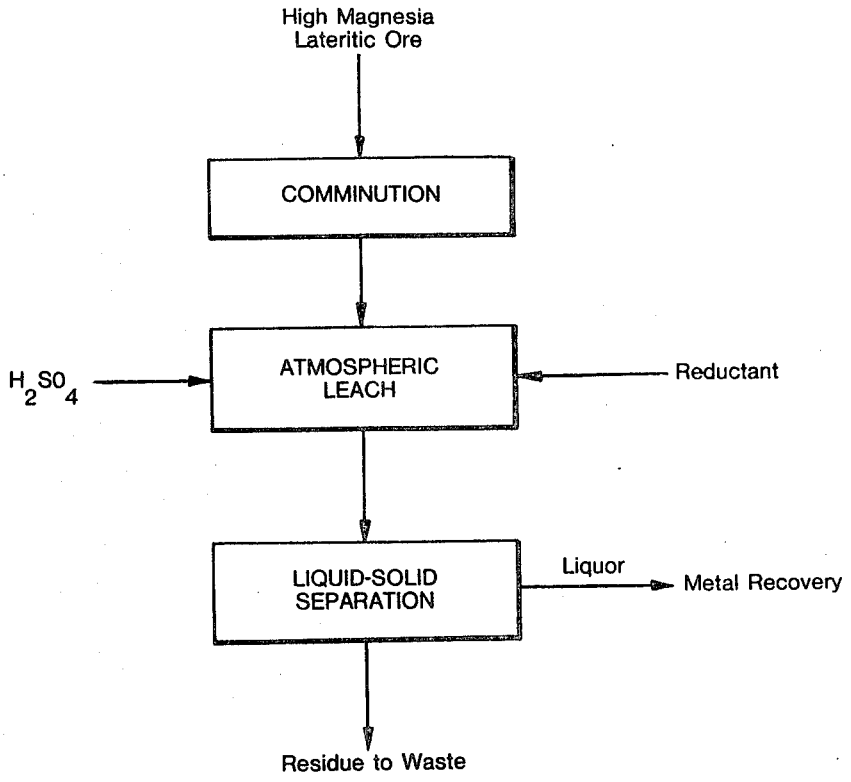

This invention describes a method to improve the recovery of non-ferrous metal values, especially of nickel and cobalt, from lateritic ores.

Due to polluting gas emissions accompanying the extraction of metals from sulphidic ores, and to the prospect of diminishing reserves of such ores, more and more effort is spent in developing methods for obtaining nickel and some other non-ferrous metals from nickeliferous laterites. The winning of nickel from laterites is usually a costly process, as most lateritic ores contain less than 4% nickel and cobalt, and can only be concentrated to a limited extent by conventional physical separation techniques.

Hydrometallurgical methods have been developed for the treatment of unroasted laterites, since these are usually economically more attractive than the energy-intensive pyrometallurgical extractive processes. Hydrometallurgical processes have two objectives: to digest the ore in order to extract the maximum amount of nickel and other non-ferrous metals available in the lateritic ore, leading inevitably to the extensive dissolution of iron and some of the magnesium-bearing components usually also present in the ore; and to separate those metals in the solution obtained that are of no value in non-ferrous metal production.

Lateritic ores can be broadly classified as being composed of two types of nickeliferous oxides, i.e., the softer and finer limonitic ores, having iron contents in the region of 40% and magnesia contents usually less than 5%, and the harder, more rocky and coarse serpentinic ores, with high silicate and relatively low iron contents and with magnesia being present usually in excess of 20%. Most lateritic ore bodies of economic grade contain both types of ore, and any hydrometallurgical process should advantageously be designed to extract nickel and cobalt from both types of ore, either combined or separated.

The separation of the limonitic from serpentinic fraction is usually carried out by conventional screening processes. The methods for the extraction of nickel and cobalt from the limonitic, high iron-bearing fraction include sulphuric acid pressure leaching, such as the Moa Bay Process, described by E. T. Carlson and C. S. Simons in an article on page 363, of the AIME, 1960, publication entitled "Extractive Metallurgy of Copper, Nickel and Cobalt". In this process for the digestion of limonitic laterites by strong sulphuric acid, a judicious selection of the acid to ore ratio leads to the subsequent precipitation of ferric and aluminum-bearing compounds, while retaining the nickel and other non-ferrous metal values in solution, thus utilizing the sulphuric acid reagent primarily for the extraction of the valuable metals.

Canadian Pat. No. 618,826 teaches a method wherein a lateritic ore is treated by a requisite amount of sulphuric acid, under pressure, and at temperatures around 200°-300° C. It is known that the higher pressures and temperatures favour the precipitation of ferric and aluminum compounds from aqueous solutions. For the economic operation of this process, a very careful control in the sulphuric acid addition is necessary, so that the final pH of the pregnant solution falls in a narrow range; too high pH will result in incomplete nickel extraction and/or reprecipitation of nickel and too low pH on the other hand, leads to high concentrations of iron and aluminum retained in the solution and to costly separating processes in subsequent steps.

U.S. Pat. No. 3,793,432 teaches the sulphuric acid leaching of iron-rich nickeliferous lateritic or similar nickel-bearing ores at a pH below 1.5 and simultaneously adding alkaline iron-precipitating agents. The process is carried out at atmospheric pressures, thereby avoiding the use of costly autoclaves. However, according to the disclosure, leaching times in excess of 20 hours at temperatures close to the boiling point are required for satisfactory extraction of non-ferrous metals and, also, the large quantities of alkaline reagents utilized in this process render it uneconomical. It is to be noted that only part of the added sulphuric acid is used for the extractive purposes intended in the process of U.S. Pat. No. 3,793,432.

In other limonitic ore fraction treating processes, which are disclosed in U.S. Pat. Nos. 3,991,159, 4,044,096 and 4,098,870, a serpentinic ore fraction is added for reducing the high acidity in the pregnant liquor obtained by pressure leaching; such neutralization is necessary for the subsequent separation or extraction of nickel and cobalt values by known methods. U.S. Pat. No. 4,065,542 teaches the atmospheric sulphuric acid leaching of limonitic ores with hydrogen sulphide sparging, followed by partial neutralization with lime, and a second stage leaching with the addition of ground manganiferous sea nodules. The leach liquour obtained is then subjected to various metal separation processes.

In another process for the extraction of nickel and cobalt values fromm high iron-bearing, limonitic laterites, disclosed in U.S. Pat. No. 4,062,924, the sulphuric acid leach is carried out in the presence of substantial amounts of hydrogen sulphide in order to effect the complete reduction and solubilization in the ferrous state, of the iron present, while precipitating nickel and cobalt sulphides and elemental sulphur.

U.S. Pat. No. 2,105,456 teaches the hydrochloric acid extraction of nickel, iron and magnesium from raw, high magnesia-bearing lateritic ores. The process of U.S. Pat. No. 2,778,729, describes the leaching of an aqueous slurry of laterites or garnierites by high pressure sulphur dioxide in order to recover nickel, cobalt and magnesium as bisulphites.

In another process described in U.S. Pat. No. 4,125,588 for the treatment of nickeliferous laterites, the finely ground dried ore is slurried in concentrated sulphuric acid, with subsequent water additions; thereby economically exploiting the heat of hydration for sulphation of the metal values, followed by water leaching of the soluble sulphates. The separation of iron sulphates simultaneously leached, is, on the other hand, a costly additional requirement in the process.

The sulphuric acid pressure leaching of high magnesia-bearing laterites is disclosed in U.S. Pat. No. 3,804,613. In this process the fresh ore is used to neutralize the pregnant liquor from the autoclave treatment, but no attempt is made to extract valuable metals from the ore added by such manner.

We have now found that it is possible to recover nickel and cobalt from lateritic ores with high magnesia contents, without prolonged and high acid strength leaching, and without the application of high pressure treatment and recycling steps.

This invention describes an improved method of solubilizing magnesia, nickel and cobalt, where present, in high-magnesia nickeliferous serpentine ore by leaching the ore with an aqueous solution of sulphuric acid to obtain maximum extraction of nickel, consistent with minimum extraction of iron and magnesia and minimum acid consumption, which comprises increasing the reactivity of the serpentine by adding to the solution a reducing agent to maintain the redox potential of the solution at a value between 200 and 400 millivolts, measured against the saturated calomel electrode (SCE).

An advantageous embodiment of this invention is an improved process for the extraction of non-ferrous metal values from lateritic ores wherein the ore is separated into a high ironbearing limonitic fraction and a high magnesia-bearing serpentinic fraction, and in the improvement the serpentinic fraction is sulphuric acid leached at atmospheric pressure with the addition of a reducing agent, such as sulphur dioxide, and its reactivity in the leach is further increased by the presence of a mixture of oxidic compounds composed of at least two selected from the group of ferric oxide, hydrated ferric oxide, basic ferric sulphate, silica, ferric silicate, alumina, and alumina hydrate. In a further advantageous embodiment the sulphuric acid is the residual acid, and the mixture of oxidic compounds are contained in the solid residue, all resulting from the leaching of the nickeliferous limonitic fraction at elevated temperatures and pressure by known methods. The neutralization of the excess acid in the slurry is advantageously combined with the extraction of valuable non-ferrous metals contained in the serpentinic fraction, while controlling the redox potential of the leaching process at a millivolt range that enhances the reaction rate at atmospheric pressure and at a temperature below the boiling point of the solution.

IN THE DRAWINGS

FIG. 1 give a schematic flowsheet of the high-magnesia lateritic ore leaching process.

Figure 2:
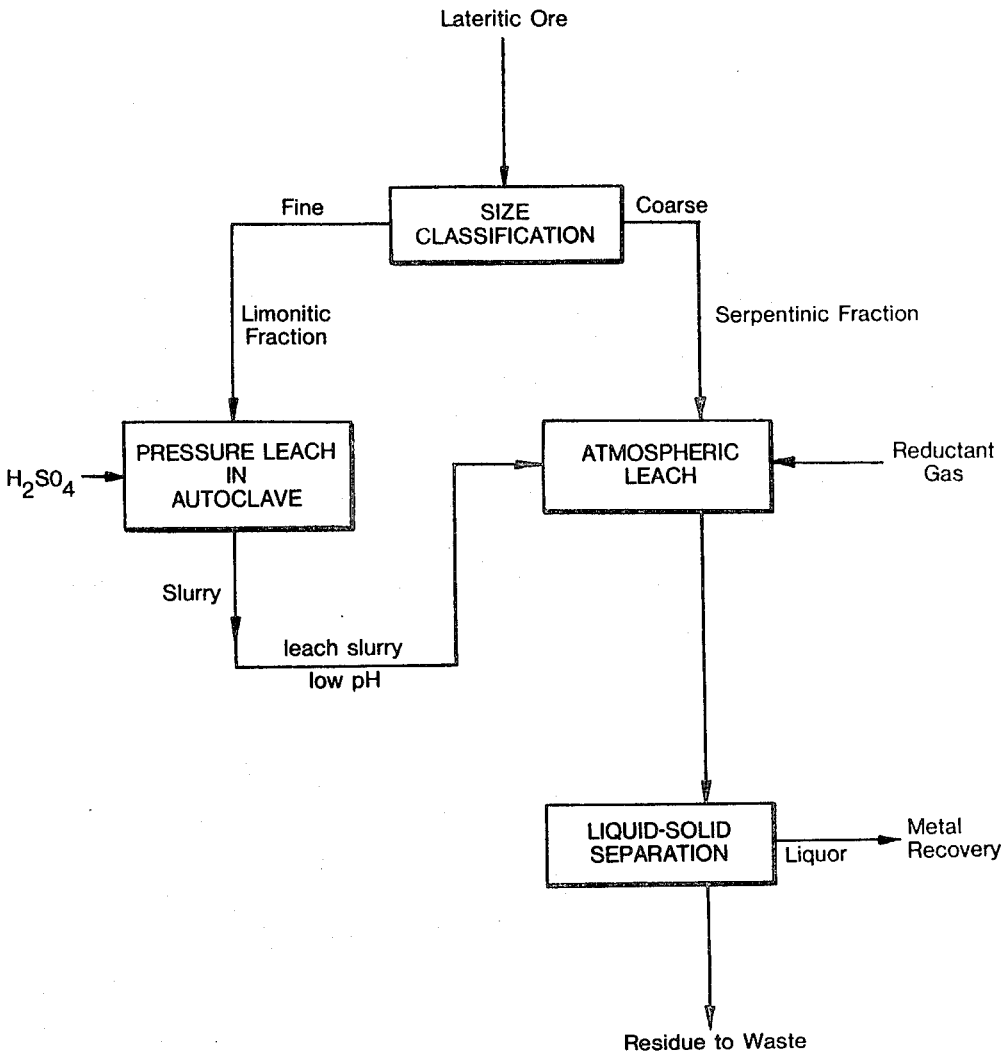

FIG. 2 provides a schematic flow diagram of an advantageous embodiment of the lateritic ore leaching process.

Figure 3:
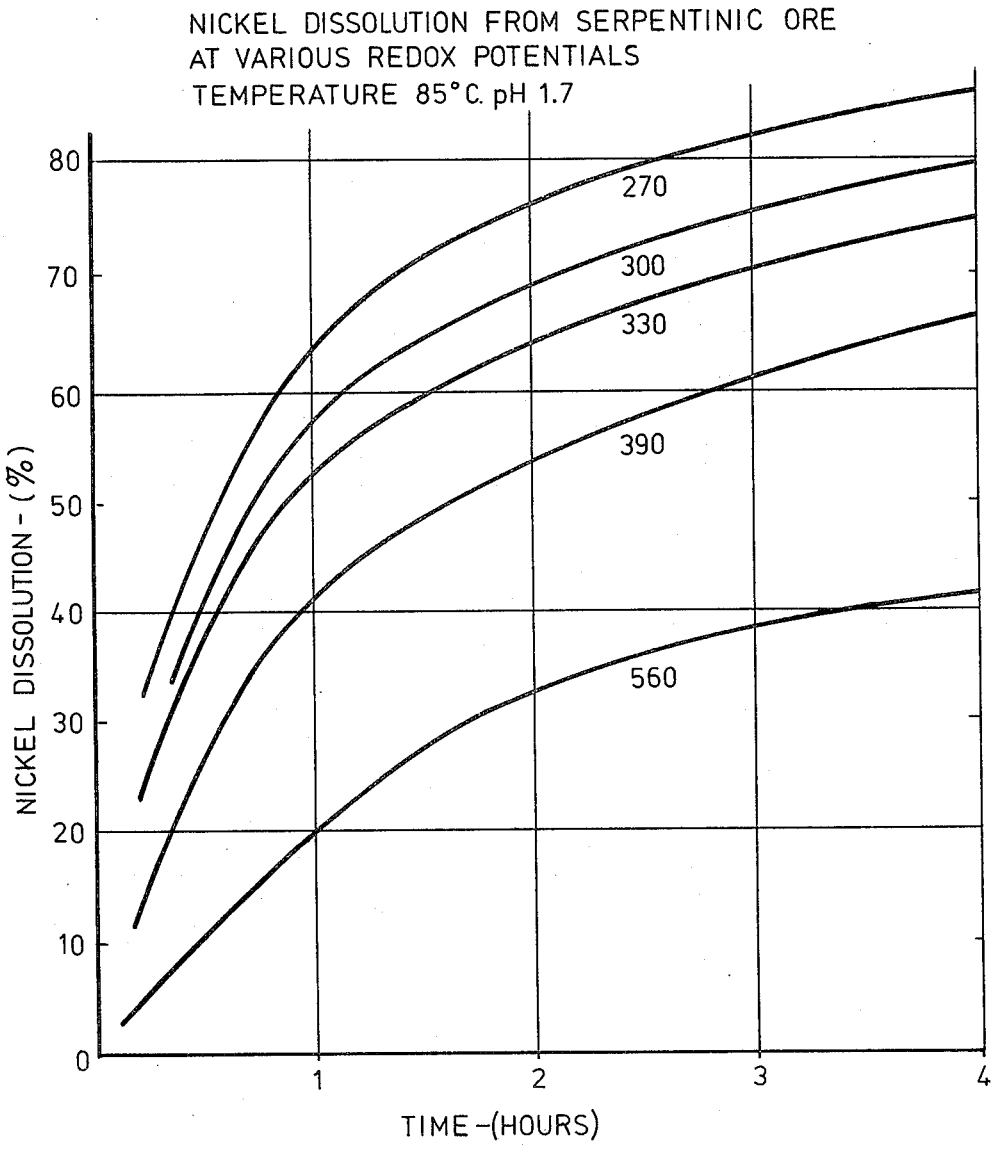

FIG. 3 shows leaching rates of a high-magnesia ore fraction.

The essential steps of the process are shown in FIG. 1. The serpentinic ore that is to be treated by this process usually contains higher than 15%, but usually in the region of 25% magnesia, iron around 10% or less and its nickel and cobalt level is usually around 2%, but frequently less. It should be stressed that these composition levels are in no way limiting; however, the process can be more advantageously applied to laterites with fairly high magnesia contents. The ground ore is sulphuric acid leached at temperatures below the boiling point and at atmospheric pressures. The pH of the leach is advantageously maintained at 1.5 to 3.0 by sulphuric acid additions. Higher pH will lead to slow reaction rate in the dissolution of the nickel and cobalt values and a lower pH will result in excess acid use and too much iron being retained in solution. The redox potential of the solution, measured against a saturated calomel electrode (SCE), is advantageously maintained between 200 and 400 mV during the leaching period by the addition of a gaseous, solubilized or solid reductant. We have found that feeding sulphur dioxide into the leach solution is a very effective method of maintaining the redox potential at the required level; but other reducing gases, such as hydrogen sulphide, or solids or reducing salt solutions such as sulphites, bisulphites, formic acid, may be employed with equal effectiveness. Over 80% of the nickel and cobalt contained in the lateritic ore may be extracted in a period of 2–4 hours when the leaching is carried out under the conditions described hereinabove. Some magnesia and most of the silica and iron are retained in the residue. The exact mechanism of the reaction is not clear but the beneficial effect is the greatly increased rate of sulphuric acid leaching of high magnesia-bearing laterites at a solution acidity, whereat the reaction would become very slow, if not completely stationary, were it not for the redox potential being maintained at the desired level. As an optional step, the slurry may subsequently be air sparged and then allowed to settle, to enhance the precipitation and separation of iron oxides and oxyhydroxides. The slurry obtained from the leaching is then treated by conventional liquid-solid separation methods, the residue is usually rejected and the liquor is subjected to conventional metal recovery processes such as sulphide precipitation, oxide-hydroxide precipitation, crystallization, ion exchange separation, solvent extraction, etc., or electrowinning of nickel, cobalt and other valuable metals.

An advantageous embodiment of the process of this invention, which can be applied to nickeliferous laterites of a wide range of compositions, is shown in FIG. 2. The lateritic ore is treated by conventional methods of screening and size classification. It has been found that the −100 mesh fraction contains mainly limonitic, high-iron ore and the fraction that is of sizes larger than 100 mesh is composed of serpentinic, high-magnesia nickeliferous ore. There is clearly no well defined boundary, as far as particle size is concerned, between the two types of ore, since it will vary according to mining location and the geological history of the ore. The fine fraction is then subjected to conventional sulphuric acid pressure leaching in the autoclave of FIG. 2. The acid to ore ratio, the temperature and the pressure will again vary according to the nature of the limonitic fines. It may be said, but it should not be regarded as limiting the process, that limonitic ores contain, in general, less than 10% magnesia and iron in excess of 15%, but limonitic laterites with as high as 45% iron and as low as 0.5% magnesia are quite common. The process is equally workable if the separation is effected at a larger size differentiation as well; selecting a larger mesh size can, however, lead to a larger portion of serpentinic ore being treeated in the autoclave, thus requiring more sulphuric acid than otherwise needed for the extraction of nickel and cobalt. For economic considerations, it is advisable to determine the optimum size differentiation for the particular type of lateritic ore to be used for the process. The limonitic ore fraction is digested in the autoclave according to known methods, to retain most of the iron, aluminum and siliceous compounds in the residue and to dissolve the nickel, cobalt and some of the other non-ferrous, valuable metals present in the ore. It has been found that, for advantageous results, the free acid content in the slurry after the pressure leach step should be in the region of 20–40 g/L.

The high magnesia-containing serpentinic fraction of the ore, which is separated in the first step, is comminuted, slurried with water and mixed with the slurry obtained in the high pressure high sulphuric acid leaching step of the limonitic fraction. The latter usually still contains free acid in excess of 20 g/L, as specified hereinabove. Further sulphuric acid is added to the combined slurries, to maintain the pH of the slurry at a value of 1.5 to 3.0, along with a reducing agent, preferably sulphur dioxide, to effect a redox potential, measured against SCE, in the region of 200–400 mV. The leaching is advantageously carried out at atmospheric pressures and at below the boiling point of the solution, with continuous agitation, neutralizing the excess acid of the limonitic leach slurry and simultaneously utilizing the acid to extract valuable metals from the serpentinic, high-magnesia ore. The duration of the leaching is a few hours, with very good yields having been obtained in 3 hours, but, naturally, this depends on the mineralogical nature of the ore. The atmospheric, reductive leaching may optionally be followed by an aeration step and the acid produced in the oxidation of the ferrous ions is usually eliminated by the unreacted magnesia still present in the residue. At the pH maintained in the slurry most of the dissolved ferric and aluminum ions will be precipitated.

The slurry obtained in the two-stage leaching processes is treated by conventional liquid-solid separation methods, the residue is washed and rejected and the liquor is treated by conventional metal recovery processes to win the nickel and cobalt contained therein.

The following examples illustrate the beneficial results obtained by the application of the process described hereinabove.

EXAMPLE 1

A nickeliferous lateritic ore, with a composition that is shown as feed composition in Table 1, below, was subjected to wet screen classification. Two main fractions were obtained in the classification, and their respective compositions are also shown in Table 1.

TABLE 1

| | Ore Composition Weight % | | | | | | | | Weight % |
|---|---|---|---|---|---|---|---|---|---|
| | Ni | Co | Fe | MnO | $Cr_2O_3$ | $SiO_2$ | $Al_2O_3$ | MgO | Distribution |
| Feed | 1.80 | 0.050 | 18.9 | 0.31 | 0.97 | 31.4 | 5.10 | 16.2 | 100 |
| +100 mesh | 1.97 | 0.02 | 9.5 | 0.18 | 0.86 | 36.3 | 2.90 | 25.6 | 40 |
| −100 mesh | 1.68 | 0.07 | 25.2 | 0.40 | 1.05 | 27.4 | 6.57 | 9.9 | 60 |

The balance of the ore analyses reported are made up by the oxygen bound to nickel, iron and cobalt, also water of crystallization and minor amounts of alkali and alkaline earth metal salts.

The +100 mesh, high-magnesia fraction, constituting 40% of the original lateritic ore, was comminuted and then subjected to sulphuric acid leaching at atmospheric pressures. During leaching the pH was maintained at 1.7, by additions of acid, and the temperature was maintained at 80° C. The conditions, including redox potential and results of the leach, are compared in Table 2. In test No. 182 the redox potential was that obtained without the addition of a reducing agent, but in test No. 183, on the other hand, the redox potential was controlled by additions of small amounts of sulphur dioxide.

TABLE 2

ATMOSPHERIC LEACH, ON 150 g +100 MESH ORE, AT 80° C. AND 1.7 pH

| Test No | Leaching Period hrs | Redox, mV Measured Against SCE | Final Slurry pH | Residue Wt. g | Residue Wt. Loss in Leach % | Residue Composition % Ni | Residue Composition % Co | Residue Composition % Fe | Dissolution % Ni | Dissolution % MgO |
|---|---|---|---|---|---|---|---|---|---|---|
| 182 | 6 | 580 | 1.7 | 122 | 18.7 | 1.38 | 1.11 | 10.6 | 43 | 30 |
| 183 | 4 | 250 | 1.8 | 106 | 29.3 | 0.57 | 0.11 | 8.0 | 80 | 70 |

The results show the very considerable improvement in nickel extraction when the redox potential of the slurry is maintained around the level of 250 mV during leaching, as compared to the extraction obtained at the redox potential without the addition of a reducing agent, even though the duration of the leaching was prolonged in the latter case.

EXAMPLE 2

120 g batches of serpentinic ore were leached in a 500 mL reaction kettle. The composition of the feed ore is shown below in weight percent:

| Ni | Co | Fe | Mn | $Cr_2O_3$ | $SiO_2$ | $Al_2O_3$ | MgO |
|---|---|---|---|---|---|---|---|
| 1.90 | 0.027 | 8.74 | 0.21 | 1.27 | 38.2 | 3.1 | 29.2 |

The leaching was carried out with agitation for 4 hours, the temperature of the slurry was kept at 85° C. and the pH was maintained during the leaching period at 1.7 by sulphuric acid additions. Sulphur dioxide gas was continously fed into the solution at a slow rate to maintain the redox potential measured against a calomel electrode, at a desired level. Samples were taken hourly, and analyzed. At the end of the 4 hour-leaching period the residues were also subjected to chemical analysis to determine their respective composition. FIG. 3 shows the percent of nickel extracted from the serpentinic ore as a function of time and redox potential in the slurry. It can be seen from the diagram that nickel extractions above 70 percent could be attained at redox potentials below 350 mV (vs SCE) within a leaching period of less than 3 hours.

EXAMPLE 3

The effect of the pH on extracting nickel, and on the amount of iron simultaneously dissolved, was studied by sulphuric acid leaching the high-magnesia fraction of the lateritic ore of Example 1 at similar temperatures and redox potentials, but at different pH levels maintained during leaching. Conditions and leach liquor compositions are shown in Table 3.

TABLE 3

ATMOSPHERIC LEACH ON 150 g, +100 MESH ORE, at 80° C.

| Test No | Leach Duration hrs | pH During Leaching | Slurry Redox mV vs SCE | Residue Wt. g | Residue Composition Wt % Ni | Co | Fe | Dissolution % Ni | Fe | MgO |
|---|---|---|---|---|---|---|---|---|---|---|
| 183 | 4 | 1.8 | 250 | 106 | 0.57 | 0.011 | 8.0 | 80 | 37 | 70 |
| 184 | 2 | 1.0 | 278 | 96 | 0.31 | 0.008 | 6.5 | 88 | 51 | 69 |

This example shows that when the leaching is carried out at a higher acidity the nickel and the cobalt dissolution will increase, but the amount of iron solubilized simultaneously is increased to a much greater degree, both in percentage, and in absolute amounts, since the iron content of the ore is higher than its nickel content. The economic consequences of having to eliminate more dissolved iron and also to raise the pH by a greater increment for the subsequent nickel recovery are obvious.

EXAMPLE 4

180 g of −100 mesh, limonite fraction of the lateritic ore, obtained in Example 1, was, after comminution, treated by conventional high pressure sulphuric acid leach in an autoclave. Leach conditions were as follows:

Temperature: 260° C.

Duration: 0.66 hours (40 min.)

After release of the pressure, the slurry was cooled and added to a slurry containing 120 g of the high-magnesia fraction from the same ore (described in Example 1) after the latter had been ground. Further amounts of sulphuric acid were added to maintain the slurry pH at 1.7 and the leaching of the combined slurries was continued at atmospheric pressure, with constant agitation, at 85° C. for 4 hours. The redox potential of the slurry during leaching was kept at 270 mV (vs SCE) by sulphur dioxide additions. The slurry was then subjected to a conventional liquid-solid separation process. The ore was observed to have lost 27% of its initial dry weight in the two stages of the leaching process, and its composition with respect to the relevent components is shown in Table 4. For the sake of comparison, the feed ore composition is also shown in Table 4.

TABLE 4

| | Feed and Residue Analysis in Wt. % Ni | Co | Fe | MgO | $Cr_2O_3$ | $Al_2O_3$ | $SiO_2$ |
|---|---|---|---|---|---|---|---|
| Feed Composition | 1.80 | 0.050 | 18.9 | 16.2 | 0.97 | 5.1 | 31.4 |
| Residue Wt: 220 g | 0.14 | 0.004 | 20.6 | 2.4 | 0.99 | 4.8 | 43.4 |

The leach liquor was subsequently treated by conventional methods for metal recovery and the solution concentrations of the relevant metals are shown in Table 5.

TABLE 5

LEACH LIQUOR Solution Composition g/L

| Ni | Fe | Mg | Al |
|---|---|---|---|
| 6.7 | 8.6 | 34.0 | 2.0 |

Calculations based on figures included in Tables 4 and 5 indicated that 93% of the nickel and 89% of the magnesia, contained initially in the feed ore, have been dissolved in the two-stage leaching process.

The figures show the high degree of nickel extraction that can be achieved by atmospherically leaching high magnesia-bearing lateritic ores in sulphuric acid at a controlled redox potential and in the presence of the slurry from the limonitic ore fraction.

EXAMPLE 5

A lateritic ore composed of both limonitic and serpentinic nickeliferous oxides was subjected to 48 mesh wet screen separation. The two fractions obtained had the following composition:

| | Size Fraction | Composition, Wt. % Ni | Co | Fe | MgO | $Al_2O_3$ | $SiO_2$ |
|---|---|---|---|---|---|---|---|
| Substantially serpentinic: | +48 mesh | 1.66 | 0.024 | 8.4 | 28.5 | 3.4 | 38.8 |
| Substantially limonitic: | −48 mesh | 1.82 | 0.065 | 26.7 | 10.6 | 5.3 | 28.4 |

The +48 mesh size fraction was dried and then ground to <−100 mesh. A 120 g. sample was then leached with sulphuric acid at 1.7 pH for 4 hours, at 85° C., with constant stirring. The redox potential in the slurry, measured against SCE, was 420 mV. This test was repeated on another 120 g. sample, with the redox potential maintained at 270 mV by sulphur dioxide additions to the slurry. The nickel extraction from the serpentinic ore was 37% and 72%, respectively. Leach conditions and analytical results are shown in Table 6.

EXAMPLE 6

The −48 mesh limonitic ore fraction of the lateritic ore of Example 5 was further ground and then leached by sulphuric acid in an autoclave at 260° C. for 40 minutes. After cooling the limonitic leach slurry was used in the leaching of the serpentinic fraction. The dried residue from the limonitic leach had a high hematite content and contained only 0.06% nickel. The combined leaching was performed under the following conditions:

(a) 120 g. of the +48 mesh, ground serpentinic ore fraction described in Example 5 was mixed with a portion of the limonitic leach slurry, which contained 134 g. dry residue, then sulphuric acid and sulphur dioxide were added to the mixture. The leach was carried out for 3.8 hours at 85° C., while the pH was maintained at 1.8 and the redox potential at 250 mV, with constant agitation. The combined slurry was then treated by a conventional liquid-solid separation process and the residue and the liquor analysed, showing that 83% of the nickel in the high-magnesia, serpentinic fraction had been extracted.

(b) 120 g. of the +48 mesh ground serpentinic ore of Example 5 was mixed with wet filtercake obtained by filtering a portion of the above limonitic leach slurry. The solid content of the filtercake was 114 g. Sulphuric acid was added to the mixture to adjust the pH at 1.7, and sulphur dioxide was added to maintain the redox potential at 260 mV. The leaching was continued with agitation for 4 hours, at 85° C. The slurry was separated by conventional liquid-solid separation techniques and both the liquor and the residue analysed. It was shown that the nickel extraction from the serpentinic ore reached 83.5%, indicating that the residue from the limonitic fraction will enhance the nickel extraction by controlled redox and acid means, irrespective of its addition being in a form of a slurry or wet solids.

(c) 120 g. of the +48 mesh ground serpentinic ore fraction of Example 5, was mixed with wet filtercake obtained by filtering a portion of the limonitic leach slurry obtained above. The solid content of the added filtercake was 120 g. Sulphuric acid was added to the mixture to maintain the pH at 1.7. The combined slurry was leached at 85° C. for 4.5 hours, with continuous agitation, and its redox potential measured against SCE was 460 mV. Analyses carried out on the residue and liquor after separation show that 52% of the nickel in the serpentinic fraction had been extracted, indicating that leaching of serpentinic ores is much less effective in the absence of redox control at the beneficial level of this invention, even in the presence of a mixture of oxide-bearing materials.

Table 6 combines the leach conditions and the analytical results of Examples 5 and 6.

TABLE 6

LEACH CONDITIONS AND ANALYSES; ATMOSPHERIC PRESSURE AND 85° C.

| TEST NO | Leach pH | Leach Duration Hours | Leach Redox mV | Residue Wt. g | Residue Composition Ni | Residue Composition Co | Residue Composition Fe | Residue Composition MgO | Extract of Ni % | Comments |
|---|---|---|---|---|---|---|---|---|---|---|
| 246 | 1.7 | 4 | 420 | 104 | 1.22 | 0.009 | 8.9 | 24.1 | 37 | Acid leach of Serpentinic Ore |
| 243 | 1.7 | 4 | 270 | 82 | 0.50 | 0.009 | 7.1 | 15.7 | 72 | Acid + $SO_2$ leach of Serpentinic Ore |
| 206 | 1.8 | 3.8 | 250 | 215 | 0.17 | 0.004 | 21.1 | 5.1 | 83 | Acid + $SO_2$ leach of Serpentinic and Limonitic Slurry |
| 205 | 1.7 | 4 | 260 | 225 | 0.18 | 0.005 | 22.0 | 4.9 | 83.5 | Acid + $SO_2$ leach of Serpentinic Ore, in presence of limonitic residue as filtercake |
| 208 | 1.7 | 4.5 | 460 | 210 | 0.47 | — | 20.7 | 8.9 | 52 | Acid leach of Serpentinic Ore, in presence of limonitic residue as filtercake |

We claim:

1. In the method of solubilizing magnesia and nickel in nickeliferous serpentine ore by leaching the ore with an aqueous solution of sulphuric acid to obtain maximum extraction of nickel consistent with minimum extraction of iron and magnesia and minimum acid consumption, the improvement which comprises maintaining the pH of the solution between 1.5 and 3.0, at atmospheric pressure, and increasing the reactivity of the serpentine by adding to the solution a reducing agent to maintain the redox potential of the solution at a value between 200 and 400 millivolts measured against SCE.

2. Method according to claim 1 in which the redox potential of the solution is controlled by the addition thereto of a reducing agent selected from the group consisting of solid, liquid and gaseous reducing agents.

3. Method according to claim 2 in which the reducing agent is a sulphur-containing compound selected from the group consisting of sulphur dioxide, sulphurous acid, alkali metal bisulphites and alkaline earth bisulphites.

4. Method according to claims 2 or 3 in which the reactivity of the serpentine at atmospheric pressure is further increased by effecting the leach in the presence of a mixture of oxidic compounds composed of at least two selected from the group consisting of ferric oxide, hydrated ferric oxide, basic ferric sulphate, silica, ferric silicate, alumina and alumina hydrate.

5. Method according to claim 4 in which the mixture of oxidic compounds is contained in the residue resulting from the leaching of nickeliferous limonite at elevated temperature with sulphuric acid.

6. Method according to claim 4 in which the sulphuric acid is residual acid, and the mixture of oxidic compounds is contained in the solid residue, both resulting from the leaching of nickeliferous limonite at elevated temperature.

* * * * *

UNITED STATES PATENT AND TRADEMARK OFFICE

CERTIFICATE OF CORRECTION

PATENT NO. : 4,410,498

DATED : October 18, 1983

INVENTOR(S) : William R. Hatch et al.

It is certified that error appears in the above-identified patent and that said Letters Patent is hereby corrected as shown below:

On the title page assignee should read -- Falconbridge Limited --.

Signed and Sealed this

*Thirty-first* Day of *July 1984*

[SEAL]

*Attest:*

GERALD J. MOSSINGHOFF

*Attesting Officer*

*Commissioner of Patents and Trademarks*